US006120266A

United States Patent [19]

Teck

[11] Patent Number: 6,120,266

[45] Date of Patent: Sep. 19, 2000

[54] PISTON MECHANISM WITH A FLOW PASSAGE THROUGH THE PISTON

[75] Inventor: Marcel Teck, Puurs, Belgium

[73] Assignee: Atlas Copco Airpower, naamloze vennootschap, Belgium

[21] Appl. No.: 09/117,951

[22] PCT Filed: Jun. 20, 1996

[86] PCT No.: PCT/BE96/00065

§ 371 Date: Dec. 15, 1997

§ 102(e) Date: Dec. 15, 1997

[87] PCT Pub. No.: WO97/01034

PCT Pub. Date: Jan. 9, 1997

[30] Foreign Application Priority Data

Jun. 20, 1995 [BE] Belgium ..... 09500544

[51] Int. Cl.[7] ..... F04B 39/10

[52] U.S. Cl. ..... 417/553; 417/545

[58] Field of Search ..... 417/437, 545, 417/552, 553

[56] References Cited

U.S. PATENT DOCUMENTS

| | | | |
|---|---|---|---|
| 2,106,236 | 1/1938 | Burke | 137/860 |
| 3,831,952 | 8/1974 | Geffroy | 92/181 |
| 4,058,104 | 11/1977 | Swoager | 123/193 |
| 4,817,390 | 4/1989 | Suganami et al. | 417/439 |
| 5,921,755 | 7/1999 | Eldridge | 417/255 |

FOREIGN PATENT DOCUMENTS

| | | |
|---|---|---|
| 378946 | 10/1931 | Belgium . |
| 8985 | 10/1879 | Germany . |
| 64-32479 | 3/1989 | Japan . |
| 6-76662 | 10/1994 | Japan . |
| 308083 | 9/1955 | Sweden . |
| 572095 | 9/1945 | United Kingdom . |
| 575095 | 9/1945 | United Kingdom . |

*Primary Examiner*—Charles G. Freay
*Assistant Examiner*—Michael K. Gray
*Attorney, Agent, or Firm*—Bacon & Thomas PLLC

[57] ABSTRACT

A piston mechanism with a flow passage through the piston includes a cylinder which has a closable cylinder passage at one extremity thereof; a piston, axially movable in the cylinder, which has a closable piston flow passage and has in its outer circumference a groove in which a piston ring is situated for sealing between the piston and the cylinder; and a movement mechanism to axially move the piston in the cylinder. The movement mechanism includes a crank shaft which is mounted in a crank chamber and a piston rod which, on the one hand, is hingedly connected to the piston by a first bearing and, on the other hand, is hingedly connected to the crank shaft by a second bearing. The piston ring is mounted with a certain axial clearance in the groove. The piston flow passage extends over the groove and the piston ring forms a valve for closing and opening the piston passage. The piston passage opens into a back side of the piston and thus medium that flows through the piston passage also flows over the first bearing by which the piston rod is connected to the piston.

6 Claims, 2 Drawing Sheets

PISTON MECHANISM WITH A FLOW PASSAGE THROUGH THE PISTON

BACKGROUND OF THE INVENTION

1. Field of the Invention

The invention relates to a piston mechanism. More particularly, the invention relates to a piston for such a mechanism with a flow passage therethrough.

2. Description of the Related Art

Such a piston mechanism allows the sucking in or intake of gaseous medium into the cylinder through the piston without an extra valve in the piston.

BE-A-378.946 describes a compressor with such a piston mechanism. However, the passage in the piston only extends partly thereover, namely from the front side up to an opening in the side which, in the utmost extended position, is not yet situated at the back side of the piston. Consequently, this passage does not open at the back side of the piston.

Gaseous medium is sucked in via chambers situated on the outside of the cylinder and consequently not via the crank chamber which is filled with oil. This oil serves to lubricate the bearings with which the piston rod is connected to the crank shaft and the piston. Hereby, the heating of the bearings is avoided, but traces of oil will be present in the obtained compressed air, which is not desirable for certain applications.

The presence of chambers at the outside of the cylinder and the use of oil to lubricate do not make the construction simple.

The gaseous medium which is sucked in through the passage flows along the wall of the cylinder which may be rather hot during operation, resulting in the heating of the medium, disadvantageously affecting the efficiency of the compressor.

A piston mechanism whereby the piston is provided with a passage which opens at the rear side of the piston and whereby the piston ring forms a valve in the passage is known from CH-A-308,083. However, this piston mechanism is not of the type concerned by the invention because the piston is stiffly connected with the piston rod and a crank chamber is not present. Therefore, such a piston mechanism does not show the problem of heating of the bearings.

SUMMARY OF THE INVENTION

According to the invention, a piston mechanism (for example, a compressor) comprises a cylinder which, at one extremity, is provided with a closable cylinder passage and, at the other extremity, opens into an interior of a crank chamber; a piston, axially movable in the cylinder, which is provided with a closable piston flow passage, and which comprises in its outer circumference a groove in which a piston ring is situated for sealing between the piston and the cylinder; and a movement mechanism to axially move the piston in the cylinder. The movement mechanism comprises a crank shaft positioned in the crank chamber and a crank or piston rod which, on one end, is hingedly connected to the piston by a first bearing, and, on the other end, is hingedly connected to the crank shaft, by a second bearing. The piston ring is positioned with a clearance in an axial direction in the groove and the piston ring forms a valve for closing and opening the piston passage.

The object of the invention is to provide a piston mechanism which does not present the above-mentioned and other disadvantages and which is not only relatively simple in construction and possesses a very good efficiency, but which can also operate without oil lubrication and yet is relatively long-lasting.

According to the invention this aim is achieved in that the piston opens at the rear side of the piston onto the first bearing.

The medium which is sucked in through the piston passage originates from the rear side of the piston and is to a minimal extent in contact with parts of the piston mechanism that are heated during the operation of the piston mechanism.

In a preferred embodiment of the invention, the piston is provided at its rear side with a cavity into which the piston passage opens and in which the first bearing is situated.

Thus, a part of the piston passage extends inwardly through a wall of the piston, whereby the possible heating of the medium sucked in through the piston passage, caused by heated parts, is considerably reduced.

In a particular embodiment of the invention, the piston mechanism forms part of an oil-free compressor. A compressed air conduit or a compressed air vessel is connected to the cylinder passage, whereby during an intake stroke the piston passage forms a piston inlet and the piston ring forms a piston inlet valve.

Preferably, the crank chamber is provided with an inlet so that the medium which flows through the piston passage also flows over the crank chamber and over the second bearing situated therein.

Particularly in the case of oil-free compressors, a problem of the heating of the bearing exists. Both bearings are cooled in the preceding embodiment by the flow of gaseous medium.

BRIEF DESCRIPTION OF THE DRAWINGS

With a view to better describe the characteristics of the invention, a preferred embodiment of a piston mechanism with passage through the piston according to the invention is described hereafter, as an example without any limitative character, reference being made to the accompanying drawings, in which.

DETAILED DESCRIPTION OF THE PREFERRED EMBODIMENTS

Figure 1:
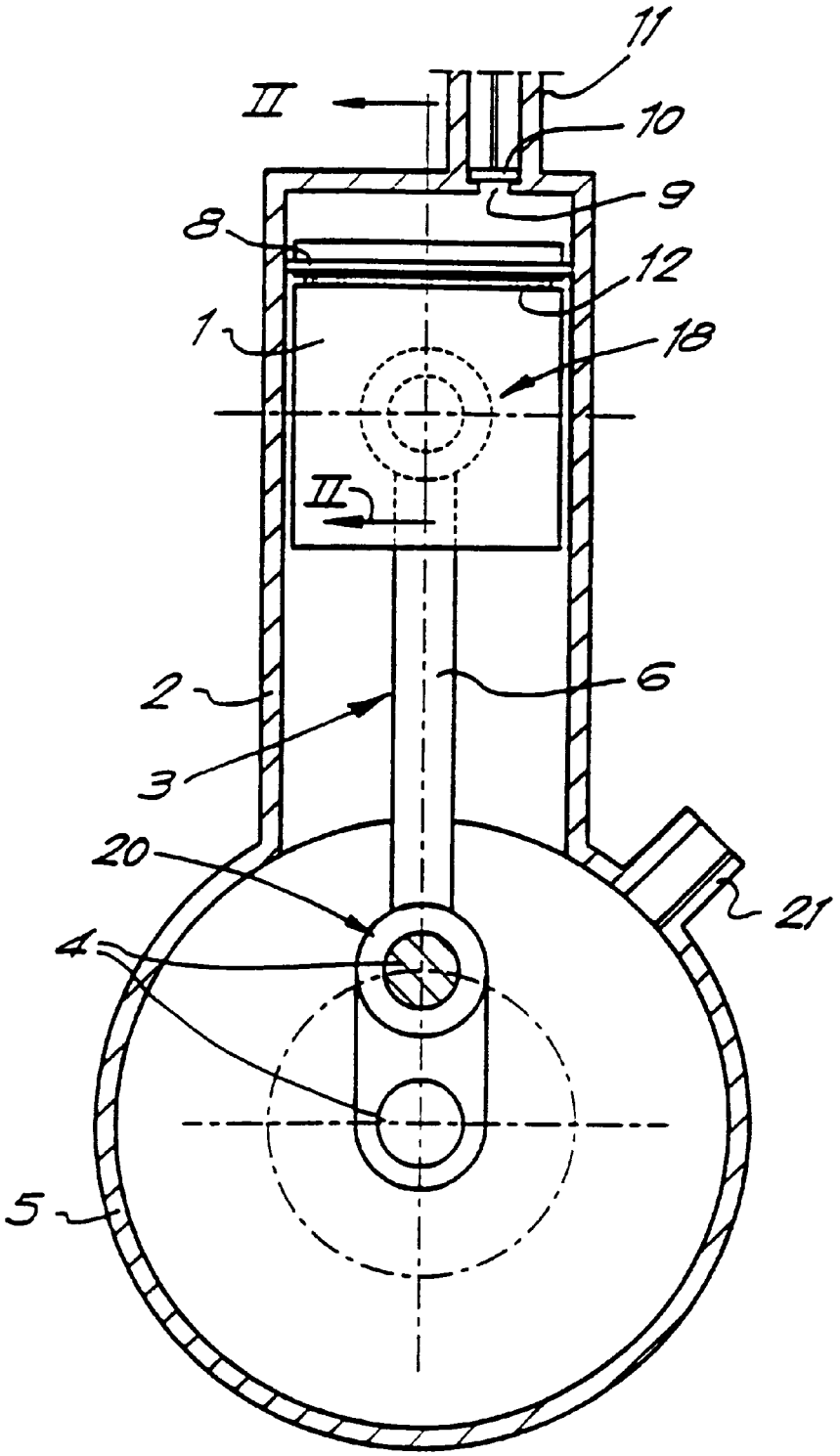
FIG. 1 is a schematic representation of a cross-section of a piston mechanism according to the invention, mounted in a piston compressor.

The piston mechanism represented in FIG. 1 forms part of an oil-free piston compressor which comprises several such piston mechanisms that essentially are composed of a piston 1 which is axially movable in a cylinder 2 and a movement mechanism 3 to axially move piston 1.

Movement mechanism 3 is essentially composed of a crank shaft 4 situated in a crank chamber 5 and driven by a motor, not represented in the figures, and a piston rod 6 which is hingedly connected to piston 1 and crank shaft 4.

Figure 2:
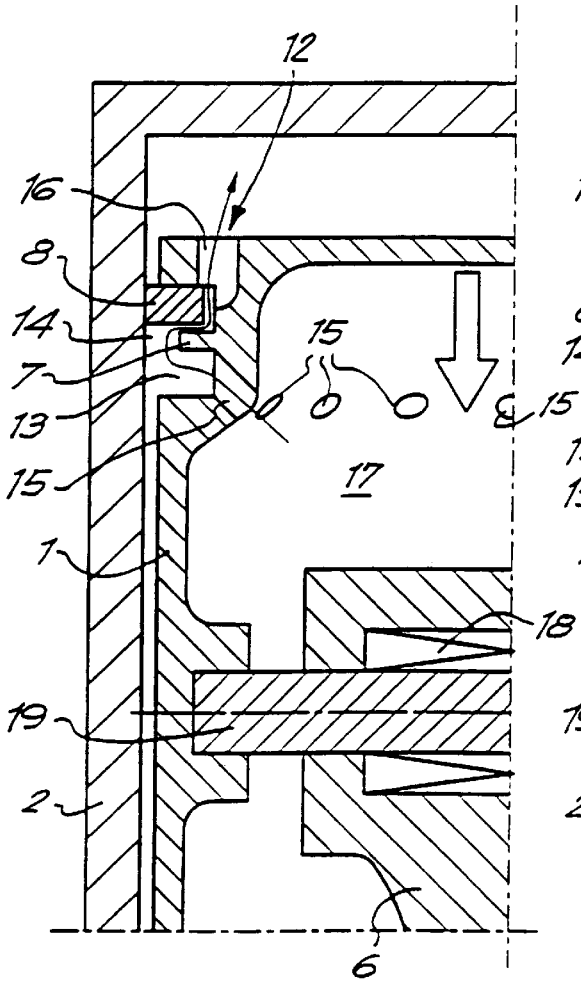
FIG. 2 is an enlarged view of a cross-section according to line II—II in FIG. 1, during an intake stroke of the piston mechanism.
Figure 3:
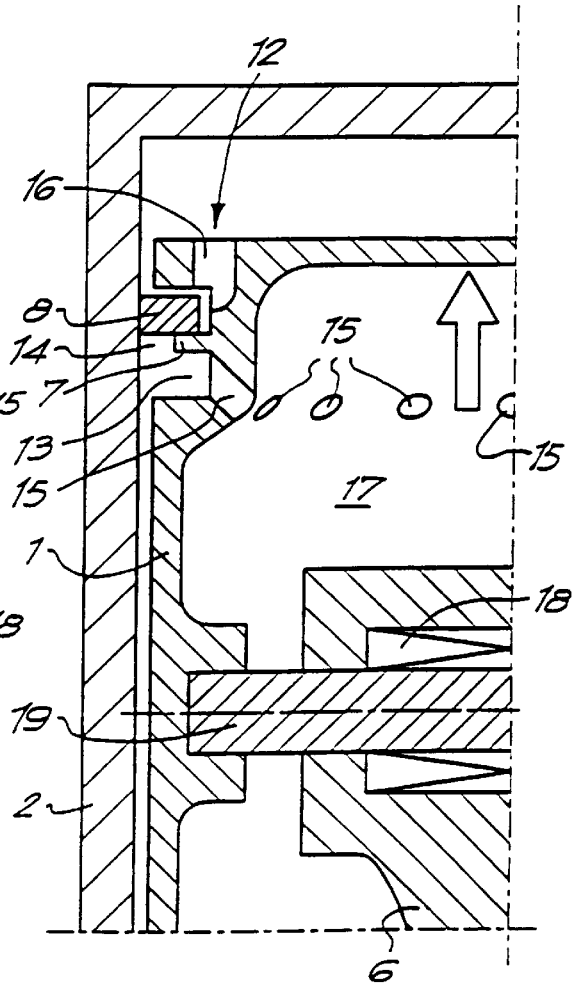
FIG. 3 is the cross-section view of FIG. 2 but during a compression stroke.

Piston 1 is provided near a front side, upper side in FIGS. 2 and 3, in other words the side directed towards the closed end of cylinder 2, with a circumferential groove 7. A piston ring 8 is applied in groove 7 which elastically contacts the inner wall of cylinder 2.

Piston ring 8 is of the self-lubricating type and is formed by a flat, interrupted ring which is fixed in groove 7 not only with a radial clearance, but with an axial clearance as well. Piston ring 8 could also be formed of an elastic ring.

This implies that the thickness of piston ring 8 is smaller than the width of groove 7, whereas the depth of groove 7 is, in the radial direction, a little greater than the width of piston ring 8.

In the closed end of cylinder 2, a closable cylinder passage 9 is applied, namely an outlet which may be selectably closed by a valve 10. A pressure or compressed air conduit 11 is connected to cylinder passage 9.

The other end of cylinder 2 opens into crank chamber 5, which is common for all the piston mechanisms of the piston compressor.

As represented in detail in FIGS. 2 and 3, a piston flow passage 12 is applied through piston 1, namely a piston inlet for the medium to be compressed which is sucked in from crank chamber 5. The piston flow passage 12 forming an inlet extends over groove 7 and is composed of groove 7, an additional groove 13 over the piston circumference located towards crank chamber 5 relative to groove 7, a recess 14 over the circumference of piston 1 which connects grooves 7 and 13 and defines a smaller outside diameter of piston 1, a first plurality of openings 15 which extend between additional groove 13 and a rear side, the bottom side in FIGS. 2 and 3, of piston 1, and a second plurality of openings 16 which extend between groove 7 and the front side 22 of piston 1.

Openings 15 and 16 are situated at a distance from the circumference of piston 1.

At the rear side 23, piston 1 is provided with a cavity 17 into which first openings 15 open.

A first bearing 18 by which one extremity of piston rod 6 is hingedly connected to piston 1, more particularly to a transverse shaft 19 mounted in cavity 17, is situated in cavity 17. First bearing 18 is, for instance, a needle bearing and is, for instance, lubricated with grease.

The other extremity of piston rod 6 is hingedly connected to crank shaft 4 by a second bearing 20 in crank chamber 5.

Bearing 20 may also be lubricated with grease.

Crank chamber 5 is provided with an inlet 21. Crank chamber 5 is not filled with oil.

The piston mechanism operates as follows.

By movement of crank shaft 4, piston 1 cyclically executes the intake stroke, with axial movement of the piston 1 in the direction of crank chamber 5, and the compression stroke in the opposite direction.

Valve 10 in the closable cylinder passage 9 forms an outlet that is opened and closed in synchronization with the movement of the piston 1 in a known manner and not further described, in such way that, during the compression stroke, valve 10 is temporarily open and compressed medium exits cylinder 2 via the closable cylinder passage 9, but is closed during the intake stroke.

Valve 10 may be mechanically controlled but may, for instance, also be a recoil valve which automatically opens and closes in the appropriate way.

In FIG. 1, piston 1 is represented in its topmost (top dead center) position, between the intake stroke and the compression stroke.

During the intake stroke, the pressure at the front side 22 of piston 1 is at a certain moment equal to the pressure at the rear side 23, the pressure in crank chamber 5.

As soon as this balance is reached, piston ring 8, on account of the friction of piston ring 8 against the inner wall of cylinder 2, will stay with respect to moving piston 1 and occupy the position shown in FIG. 2, whereby second openings 16 via groove 7 and recess 14 are in an open connection with additional groove 13 and further via first openings 15 with cavity 17 of piston 1.

Gaseous medium, for instance air, may flow via thus formed piston passage 12 or piston inlet to the front side of piston 1.

It is evident that this medium is sucked in via inlet 21 over crank chamber 5 and through the extremity of cylinder 2 opening into it, through cavity 17 and through the piston flow passage 12. Thus, this medium flows over second bearing 20 in crank chamber 5 and over first bearing 18 in piston 1.

Bearings 18 and 20, and the grease used for lubrication thereof, are thus cooled.

Crank chamber 5 is also cooled by this medium.

The piston flow passage 12 itself is rather short and moreover includes components, namely openings 15 and 16, which are not in direct contact with hot parts of the piston mechanism, in particular of cylinder 2.

As a result, the medium sucked in through the piston flow passage 12 is practically not heated, whereby a very good degree of filling of the cylinder and a very good efficiency are obtained.

When, after reaching its bottommost (bottom dead center) position, piston 1 moves in the opposite direction, piston ring 8 will tend to stay on account of the friction of piston ring 8 against the inner wall of cylinder 2. This also occurs as soon as the pressure at the front side of piston 1 is equal to the pressure at the rear side.

Prior to the higher pressure arising at the front side 22 of piston 1, in comparison with the rear side 23 of piston 1, piston ring 8 thereby closes recess 14 in such a way that the connection between groove 7 and additional groove 13 is broken and thus piston flow passage 12 is closed, as represented in FIG. 3.

It is evident that by the friction of piston ring 8 against cylinder 2, the closing during the compression stroke and the opening during the intake stroke are accelerated, so that the compression or intake, respectively, starts faster, which results in an ameliorated operation of the piston principle.

For the same compressed output, less power is hereby lost and a better compression efficiency is obtained.

The invention is in no way limited to the embodiment described above and represented in the figures, but such a piston mechanism may be realized in different variants without leaving the scope of the invention.

In particular the bearings need not necessarily be needle bearings or the like. They may also be slide bearings, whereby parts of the piston rod surround the corresponding shaft with only a lubricant between them.

What is claimed is:

1. A piston mechanism with a flow passage through the piston, said piston mechanism comprising:

a cylinder having a closable cylinder passage at one extremity and opening into an interior of a crank chamber at another extremity;

a piston, axially movable in said cylinder, said piston having a front side and a rear side, a closable piston flow passage and a groove in an outer circumference thereof;

a piston ring mounted in said groove such that said piston ring forms a seal between said piston and said cylinder, said piston ring mounted with an axial clearance in said groove so that it is axially movable in the groove;

a movement mechanism arranged to axially move said piston in said cylinder, said movement mechanism comprising a crank shaft mounted in said crank chamber and a piston rod hingedly connected at one end to said piston by a first bearing and hingedly connected at another end to said crank shaft by a second bearing;

said piston flow passage extending over said groove and opening at said rear side of said piston onto said first bearing; and said piston ring upon axial movement in the groove as a valve being operable to open and close said piston flow passage in response to piston movement in the cylinder.

2. A piston mechanism according to claim 1, wherein said piston includes a cavity at said rear side of said piston into which said piston flow passage opens and in which said first bearing is situated.

3. A piston mechanism according to claim 1, wherein said piston mechanism includes a compressed-air conduit connected to said closable cylinder passage, and during an intake stroke of said piston, said piston flow passage defines a piston inlet and said piston ring defines a piston inlet valve.

4. A piston mechanism according to claim 1, wherein said second bearing is situated in said crank chamber and said crank chamber is provided with an inlet such that a medium which flows through said piston passage also flows through said crank chamber and over said second bearing.

5. A piston mechanism according to claim 1, wherein said piston flow passage includes a first opening which opens into said rear side of said piston and a second opening which extends between said groove and said front side of said piston and opens at least partially into said groove adjacent said piston ring, said first and second openings located at a distance from said outer circumference.

6. A piston mechanism according to claim 5, further comprising:

an additional groove in said outer circumference of said piston which connects to said first opening; and a recess which is formed by a smaller outside diameter of said piston and which connects said groove to said additional groove.

* * * * *